US008278578B2

(12) United States Patent
Yang et al.

(10) Patent No.: US 8,278,578 B2
(45) Date of Patent: Oct. 2, 2012

(54) KEY ASSEMBLY AND PORTABLE ELECTRONIC DEVICE USING THE SAME

(75) Inventors: Mu-Wen Yang, Taipei Hsien (TW); Chih-Chiang Chang, Taipei Hsien (TW)

(73) Assignee: FIH (Hong Kong) Limited, Kowloon (HK)

( * ) Notice: Subject to any disclaimer, the term of this patent is extended or adjusted under 35 U.S.C. 154(b) by 527 days.

(21) Appl. No.: 12/502,302

(22) Filed: Jul. 14, 2009

(65) Prior Publication Data

US 2010/0053871 A1 Mar. 4, 2010

(51) Int. Cl.
*H01H 13/00* (2006.01)
*H01H 3/00* (2006.01)

(52) U.S. Cl. ..... 200/339; 200/343

(58) Field of Classification Search ..... 200/339, 200/315, 552, 553, 557, 561–563, 343
See application file for complete search history.

(56) References Cited

U.S. PATENT DOCUMENTS 4,117,280 A * 9/1978 Feaster ..... 200/339
5,749,457 A * 5/1998 Castaneda et al. ..... 200/343
6,037,552 A * 3/2000 Yamada ..... 200/339
7,094,983 B2 * 8/2006 Tsunemoto ..... 200/339

* cited by examiner

*Primary Examiner* — Renee Luebke
*Assistant Examiner* — Lheiren Mae Caroc
(74) *Attorney, Agent, or Firm* — Altis Law Group, Inc.

(57) ABSTRACT

A key assembly comprises a base plate and a key. The base plate has an opening defined therein. The key is accommodated in the opening, and includes a first key section, a second key section connecting with the first key section and a shaft portion protruding from the junction of the first key section and the second key section. The shaft portion is rotatably mounted to the housing. The key further includes two contacting members, one contacting member is mounted on the first key section, another contacting member is mounted on the second key section. When the first key section is pressed to rotate about the shaft portion, the contacting member mounted on the first key section moves in a direction perpendicular to the direction that the first key section is pressed, and the contacting member mounted on the second key section moves in a direction reverse to the direction that the contacting member mounted on the first key section moves.

18 Claims, 5 Drawing Sheets

KEY ASSEMBLY AND PORTABLE ELECTRONIC DEVICE USING THE SAME

This application is related to co-pending U.S. patent applications Ser. Nos. 12/502,297 and 12/502,308, entitled "KEY ASSEMBLY AND PORTABLE ELECTRONIC DEVICE USING THE SAME", by Mu-Wen Yang et al. Such application has the same assignee as the present application and has been concurrently filed herewith. The above-identified application is incorporated herein by reference.

BACKGROUND

1. Technical Field

The exemplary disclosure generally relates to key assemblies, and particularly to key assemblies used in portable electronic devices.

2. Description of Related Art

With the development of smaller and lighter electronic devices for portable use, key assemblies become more compact with individual keys more tightly spaced. Unfortunately, users of these portable electronics sometimes experience difficulty in activating keys that are close together; multiple and/or erroneous keys may be activated at the same time. This drawback exists not only in cellular telephones, but other portable electronic devices with key assemblies. Also, keys of the key assemblies can be too crowded to allow quick, accurate activation.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the exemplary key assembly and portable electronic device using key assembly. Moreover, in the drawings like reference numerals designate corresponding parts throughout the several views. Wherever possible, the same reference numbers are used throughout the drawings to refer to the same or like elements of an embodiment.

DETAILED DESCRIPTION

Figure 1:
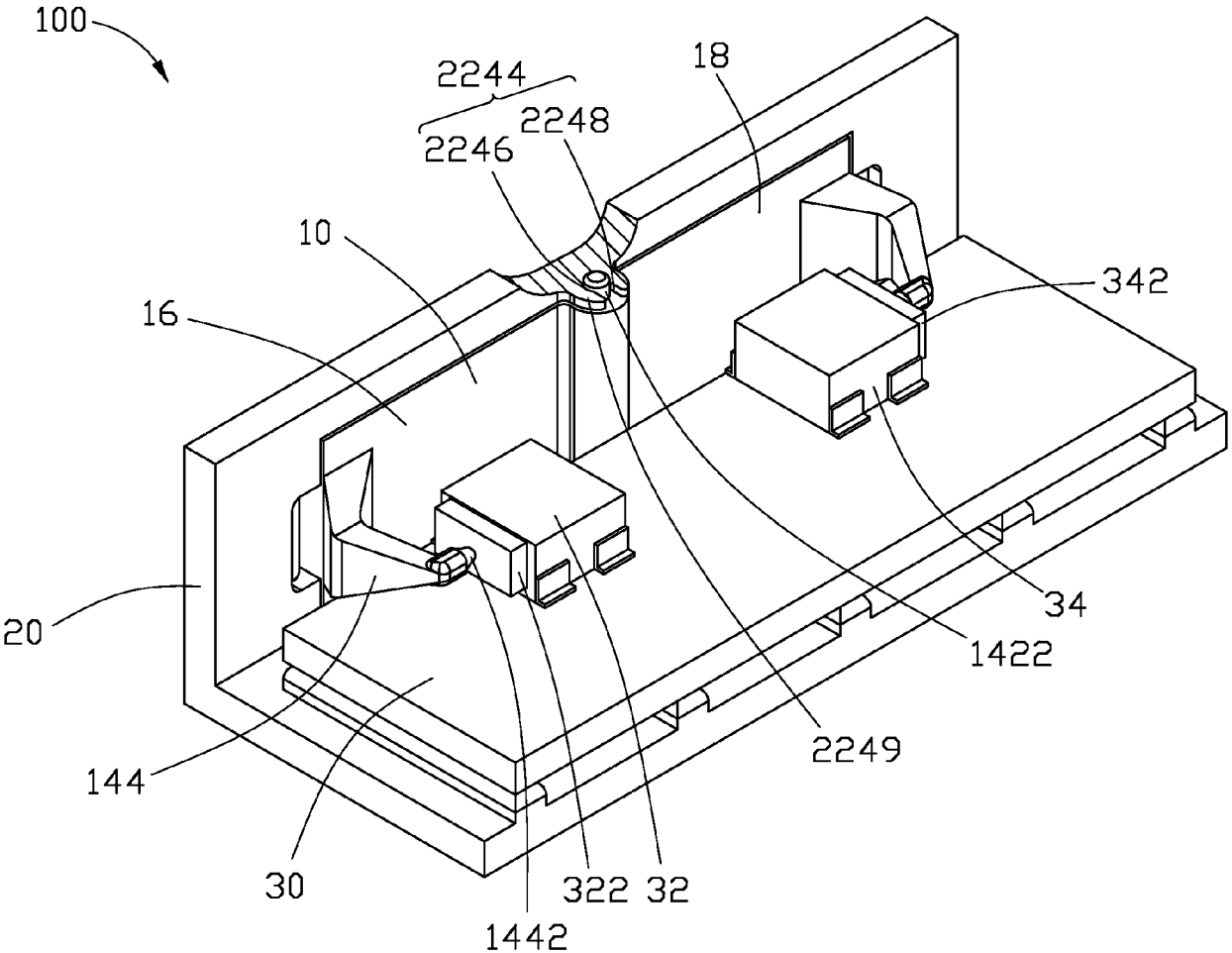
FIG. 1 is an assembled, cutaway view of one embodiment of a key assembly used in a portable electronic device, the portable electronic device including the key assembly, a housing, and a circuit board.
Figure 2:
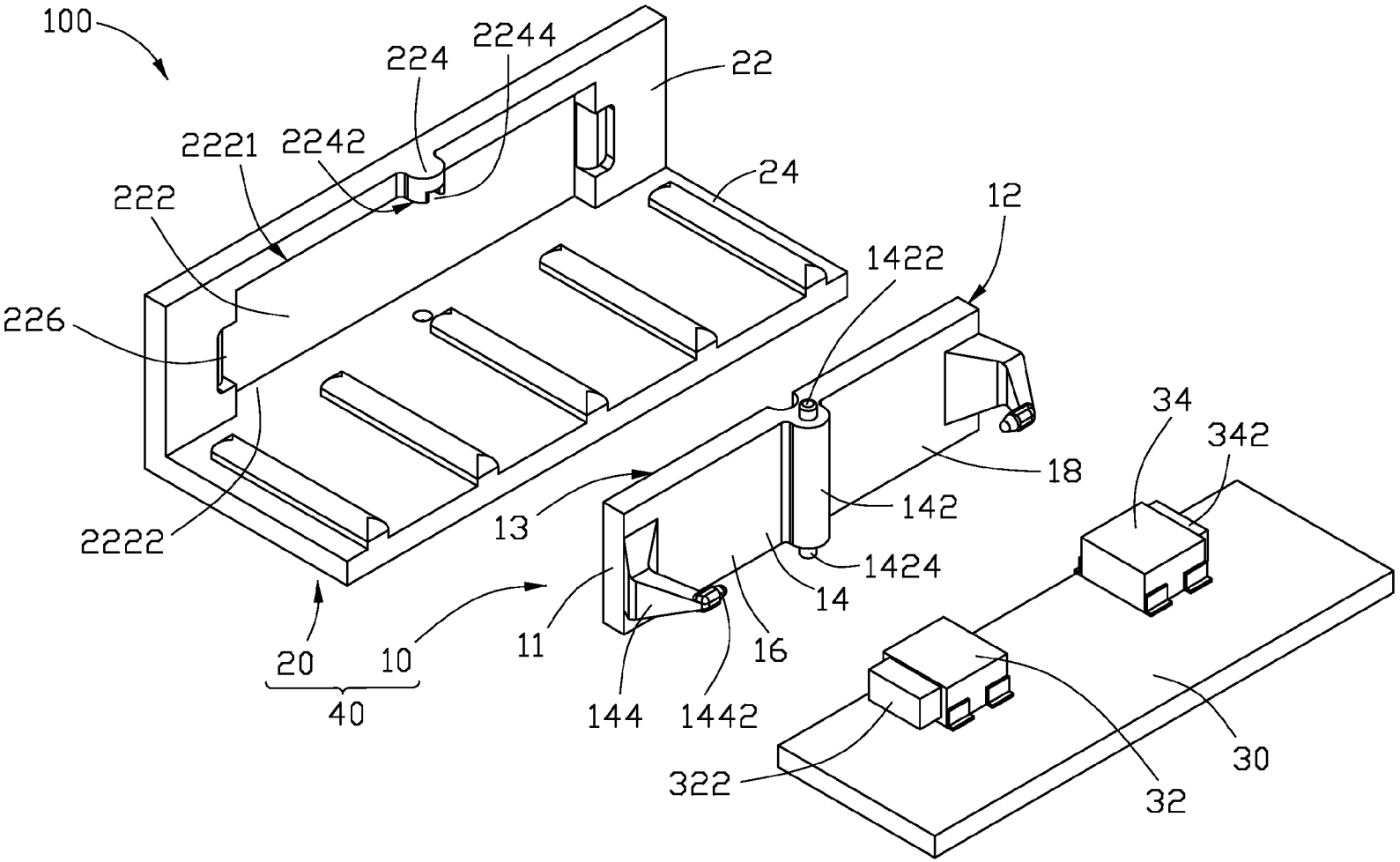
FIG. 2 is an exploded, isometric view of the portable electronic device shown in FIG. 1.

Referring to FIGS. 1 and 2, an exemplary embodiment of a key assembly 40 can be used on a portable electronic device 100, such as a cellular phone or any electronic device where a key is desirable. The portable electronic device 100 includes a circuit board 30 and a key assembly 40 configured to control the circuit board 30. The circuit board 30 has a first switch 32 and a second switch 34 spaced from the first switch 32. The first switch 32 has a first contact 322 mounted at a sidewall thereof, which is perpendicular to the key assembly 40, not facing toward the key assembly 40. The second switch 34 has a second contact 342 at a sidewall thereof, which is perpendicular to the key assembly 40 and also does not face toward the key assembly 40. The first contact 322 is disposed opposite to the second contact 342. The key assembly 40 is configured so that pressing of the first contact 322 and the second contact 342 can control the circuit board 30.

The key assembly 40 includes a base plate 20 and a key 10 rotatably mounted to the base plate 20. The base plate 20 may be a portion of the housing of the portable electronic device 100 or may be a separate element mounted to the housing of the portable electronic device 100. In this embodiment, the base plate 10 is a portion of the housing of the portable electronic device 100.

Figure 3:
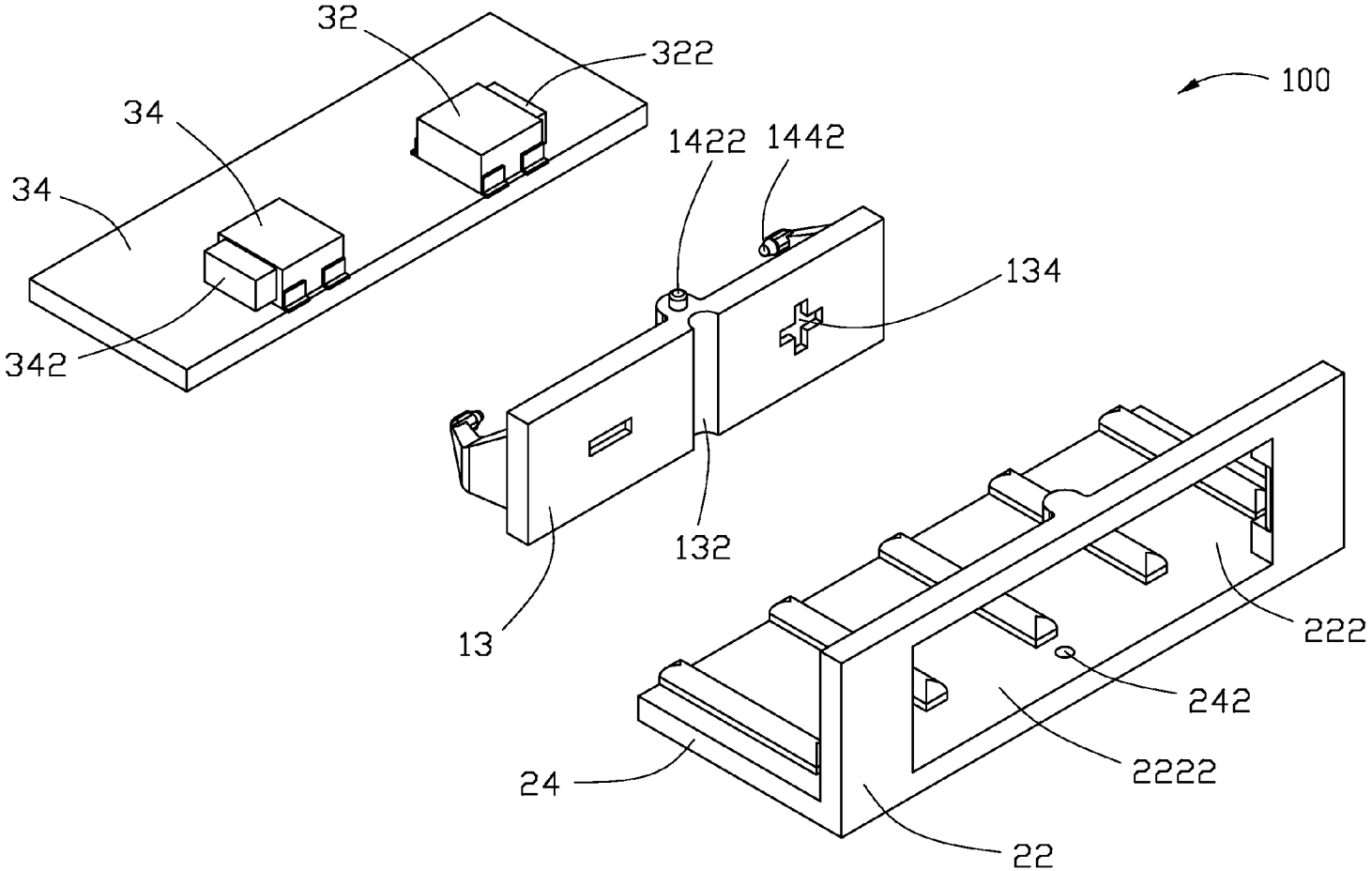
FIG. 3 is similar to FIG. 2, but showing the portable electronic device in another aspect.

Referring to FIGS. 2 and 3, the key 10 is substantially rectangular, however, other shapes may be substituted. The key 10 has a first end 11, a second end 12 opposite to the first end 11, an operating surface 13 facing the outside of the portable electronic device 100 and a contacting surface 14 opposite to the operating surface 13.

The operating surface 13 has a trough 132 transversely defined in a center thereof, the contacting surface 14 has a shaft portion 142 opposite to the trough 132 of the operating surface 13, thus the key 10 is divided into a first key section 16 located one side of the trough 132 and a second key section 18 located another side of the trough 132. The role of the trough 132 is to facilitate the first key section 16 bending relative to the second key section 18, thus the contact sensation of the key 10 is improved. The shaft portion 142 has a first shaft 1422 and a second shaft 1424 respectively protruding from two opposite ends thereof. The first shaft 1422 and the second shaft 1424 are coaxial. The first shaft 1422 and the second shaft 1424 are rotatably assembled to the base plate 20.

The key 10 has two contacting members 144 protruding from the contacting surface 14. One contacting member 144 is located on the first key section 16 adjacent to the first end 11, another contacting member 144 is located on the second key section 18 adjacent to the second end 12. The contacting members 144 may be substantially V-shaped, however, other shapes may be substituted. In this embodiment, the contacting members 144 are substantially V-shaped, and the V-shaped openings of the contacting members 144 face each other. Each contacting member 144 has a contacting portion 1442 protruding from a distal end thereof and parallel to the first key section 16 and the second key section 18. The contacting portions 1442 extend from respective contacting member 144 toward each other. The contacting portions 1442 are configured for triggering the first switch 32 and the second switch 34, respectively. The contacting portions 1442 may be constructed from injection-molded thermoplastic elastomer and configured to produce a point contact sensation in a user's fingertip to provide tactile feedback when a user presses the key 10.

The operating surface 13 has two indicia 134 correspondingly defined in the first key section 16 and the second key section 18, to indicate the function of the first key section 16 and the second key section 18. The indicia 134 of the first key section 16 may be a "+", to indicate the function of the first key section 16 is increasing volume. The indicia 134 of the second key section 18 may be a "−", to indicate the function of the second key section 18 is decreasing volume.

The base plate 20 includes a peripheral wall 22 and a bottom wall 24 substantially perpendicularly connected to the peripheral wall 22. The peripheral wall 22 has a hole 222 defined therein corresponding to the key 10. The hole 222 is sized and configured to be engaged with the key 10. The peripheral wall 22 has a first inner wall 2221 and a second inner wall 2222 opposite to the first inner wall 2221, both of which are defined in the hole 222. The first inner wall 2221 is parallel to the bottom wall 24 and the second inner wall 2222 is level with the bottom wall 24.

The peripheral wall 22 further has a protrusion 224 protruding from an inner surface thereof and located adjacent to the first inner wall 2221. The protrusion 224 has a surface 2242 facing the bottom wall 24 and level with first inner wall 2221. The protrusion 224 has a mating space 2244 (see FIG. 1) defined in the surface 2242 and corresponding to the first shaft 1422. The mating space 2244 includes a circular first rotating aperture 2246 defined in a center of the surface 2242 and a guiding groove 2248 defined in a distal end of the protrusion 224. The cross-section of the first rotating aperture 2246 is the same size and shaped as the first shaft 1422 and is configured to accommodate the first shaft 1422 therein. The cross-section of the guiding groove 2248 is rectangular and the guiding groove 2248 communicates with the first rotating aperture 2246. The width of the guiding groove 2248 is smaller than the diameter of the first shaft 1422, the guiding groove 2248 is configured to guide the first shaft 1422 into the first rotating aperture 2246.

Figure 5:
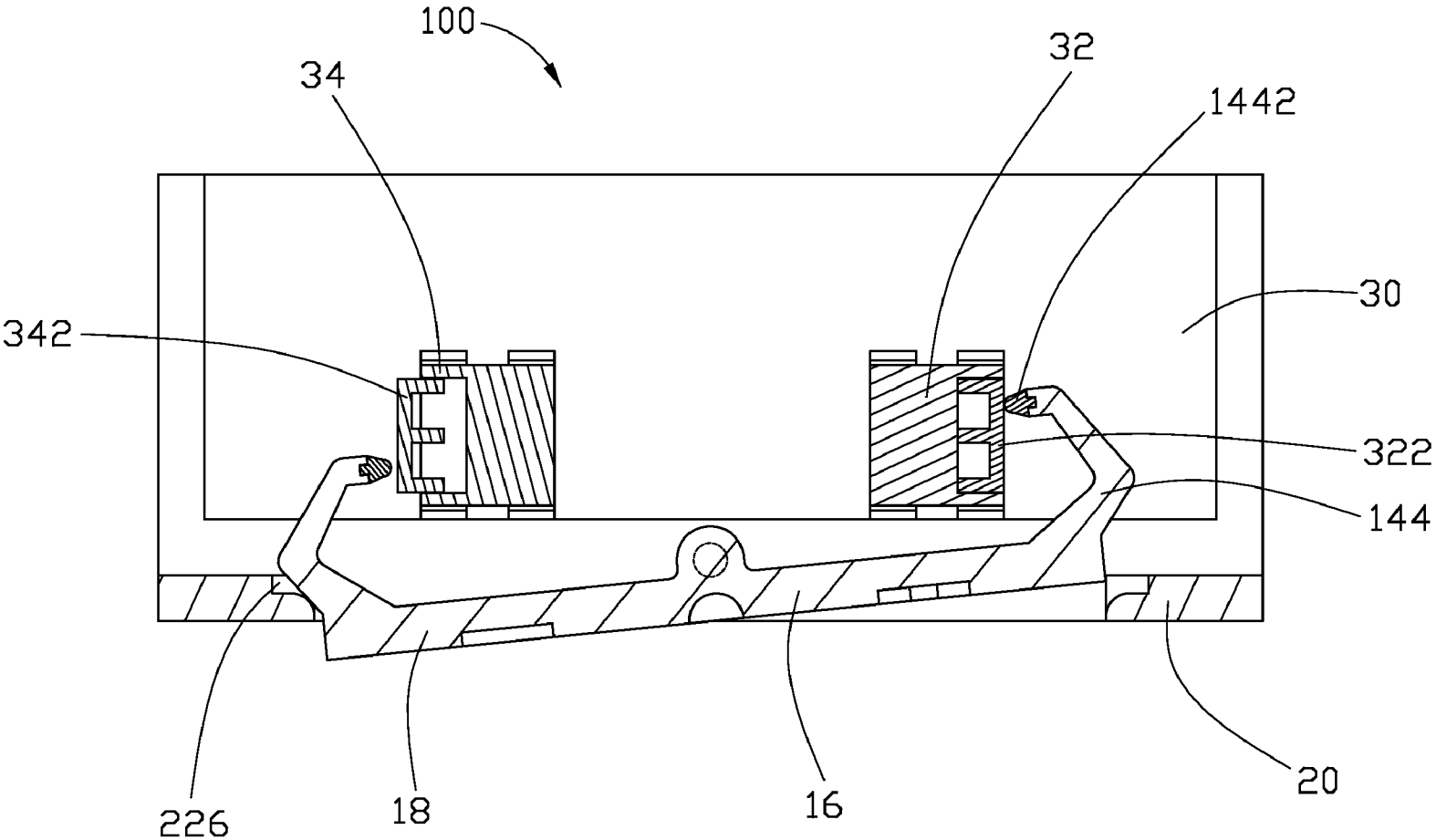
FIG. 5 is similar to FIG. 4, but one key in pressed.

The protrusion 224 has two expanding portions 2249 (Seen FIG. 1) formed at the two sides of the guiding groove 2248, respectively. When the first shaft 1422 moves in the guiding groove 2248, the expanding portions 2249 are bent away from each other to enlarge the width of the guiding groove 2248 such that the first shaft 1422 can easily enter into the first rotating aperture 2246. Once the first shaft 1422 enters into the first rotating aperture 2246, the expanding portions 2249 restore their original state to limit the first shaft 1422 accommodated in the first rotating aperture 2246. The peripheral wall 22 further has two notches 226 defined in an inner wall thereof and communicating with the hole 222. Referring to FIG. 5, the notches 226 correspond to the contacting member 144, and when the key 10 rotate about the base plate 20, the notches 226 is configured to receive portions of the contacting member 144 such that the key 10 can be freely rotated about the base plate 20 within a certain angle.

The bottom wall 24 has a circular second rotating aperture 242 (see in FIG. 3) defined therein and located adjacent to the second inner wall 2222. The second rotating aperture 242 and the first rotating aperture 2246 are opposite and coaxial. The second shaft 1424 is rotatably accommodated in the second rotating aperture 242.

Referring to FIGS. 1 and 3, to assemble the portable electronic device 100, first, the second shaft 1424 is installed in the second rotating aperture 242. Second, the first shaft 1422 is slid into the first rotating aperture 2246 by the guiding groove 2248, so the key 10 is fixed to the base plate 20. Then, the circuit board 30 is mounted to the bottom wall 24, thus yielding an assembled portable electronic device 100. At this stage, the first switch 32 and the second switch 34 are located between the connecting portions 1442 of the key 10. In detail, the first switch 32 is located in front of and parallel to the first key section 16, the second switch 34 is located in front of and parallel to the second key section 18, and the first contact 322 faces the contacting portion 1442 of the first key section 16 in a direction parallel to the first key section 16, the second contact 342 faces the contacting portions 1442 of the second key section 18 in a direction parallel to the second key section 18. In other words, the first contact 322 is facing in a direction parallel to the first key section 16, and the second contact 342 is facing in a direction parallel to the second key section 18.

Figure 4:
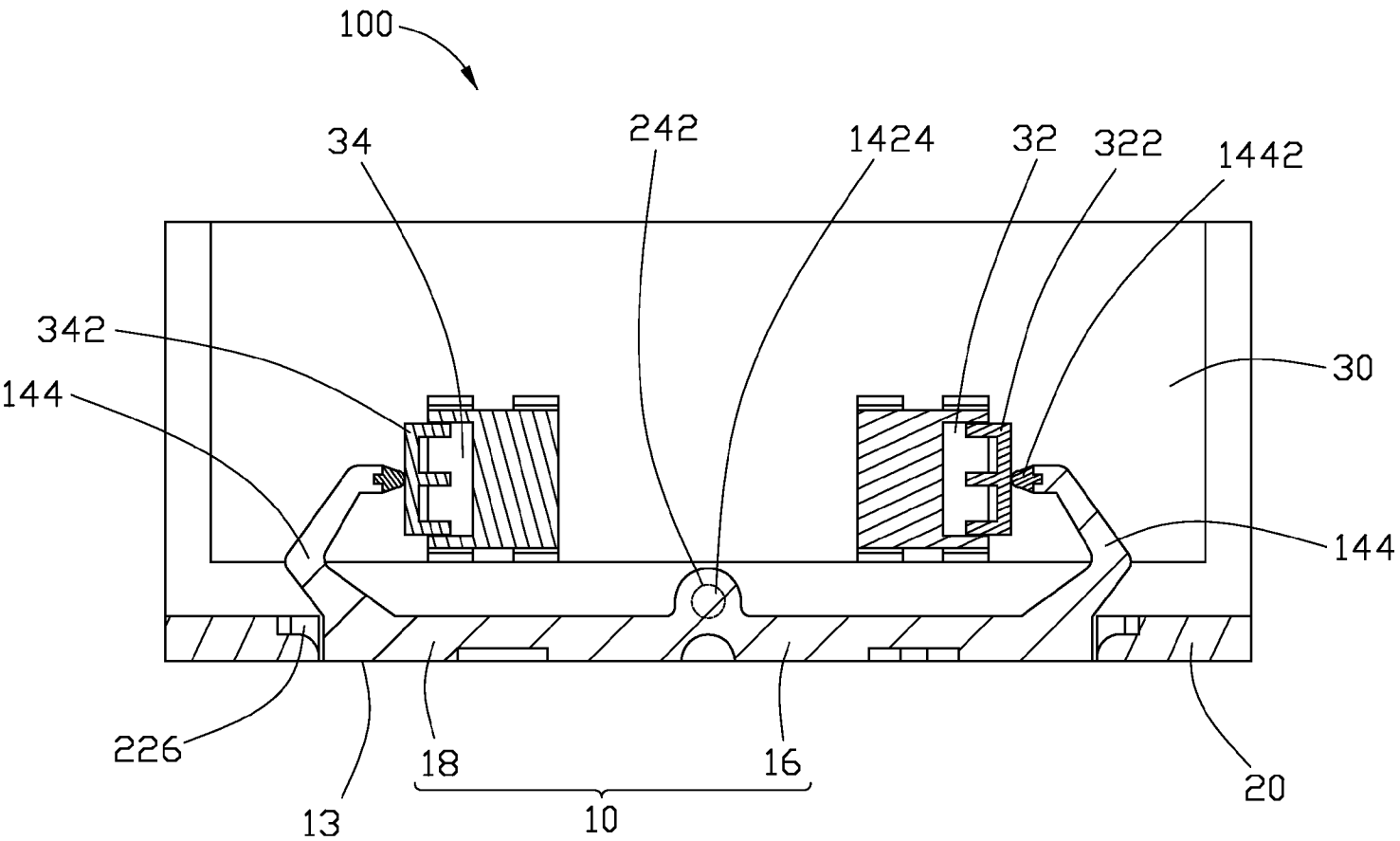
FIG. 4 is a cross-sectional view of the portable electronic device shown in FIG. 1.

Referring further to FIGS. 4 and 5, in which the first key section 16 is pushed, and so action of only the first key section 16 is described herein, but applies to the second key section 18 also. First, the first key section 16 is pressed toward the first switch 32 of the circuit board 30, so the first key section 16 rotates about the first shaft 1422 (not shown in FIGS. 4 and 5) and the second shaft 1424, to enter into the inner side of the peripheral wall 22, and the contacting portion 1442 of the first key section 16 moves in a direction perpendicular to the direction that the first key section 16 is pressed, until the contacting portion 1442 of the first key section 16 trigger the first contact 322. Additionally, the contacting portion 1442 is compressed to accumulate elastic force, thus the first key section 16 can rebound when released.

Simultaneously, the second key section 18 reversely rotates about the first shaft 1422 and the second shaft 1424, thus the contacting portion 1442 of the second key section 18 move away from the second contact 342 in a direction reverse to the direction that the contacting portion 1442 of the first key section 16 moves. Additionally, the contacting member 144 of the second key section 18 is partially accommodated in the notch, and the contacting member 144 of the second key section 18 is resisted against the bottom portion in the corresponding notch 226 to prevent the second key 10 from detaching from the peripheral wall 22.

When the first key section 16 is pressed to trigger the first switch 32, the contacting portion 1442 of the second key section 18 moves away from the second switch 34, such that a user's fingertip touches only one key section at a time, thus removing the possibility of hitting two keys simultaneously. Additionally, the direction of the contacting portions 1442 which trigger the first contact 322 and the second contact 342 is correspondingly perpendicular to the direction of pressing the first key section 16 and the second key section 18, effectively avoiding two keys being activated at once, even if greater force is used to press the key 10.

It is to be understood, however, that even though numerous characteristics and advantages of the exemplary disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A key assembly comprising:

a base plate, the base plate having an opening defined therein; and a key, the key accommodated in the opening, and including a first key section, a second key section connecting with the first key section and a shaft portion protruding from the junction of the first key section and the second key section, the shaft portion being rotatably mounted to the base plate;

wherein the key further including two contacting members, one contacting member is mounted on the first key section, another contacting member is mounted on the second key section, each contacting member has a contacting portion protruding from a distal end thereof toward the other contacting member, the contacting portions respectively parallel to the first key section and the second key section; when the first key section is pressed to rotate about the shaft portion, the contacting member mounted on the first key section moves in a direction perpendicular to the direction that the first key section is pressed, and the contacting member mounted on the second key section moves in a direction reverse to the direction that the contacting member mounted on the first key section moves.

2. The key assembly of claim 1, wherein the shaft portion has a first shaft and a second shaft respectively protruding from two opposite ends thereof, the first shaft and the second shaft are co-axial, the base plate has a first rotating aperture and a second rotating aperture opposite to and coaxial with the first rotating aperture, the first shaft is rotatably accommodated in the first rotating aperture, the second shaft is rotatably accommodated in the second rotating aperture.

3. The key assembly of claim 2, wherein the base plate includes a peripheral wall and a bottom wall perpendicularly connected to the peripheral wall, the opening is defined in the peripheral wall, the peripheral wall has a protrusion protruding from an inner surface thereof, the first rotating aperture is defined in the protrusion facing the bottom wall, the second rotating aperture is defined in the bottom wall.

4. The key assembly of claim 3, wherein the protrusion has a surface facing the bottom wall, the first aperture defined in the surface of the protrusion, the protrusion further has a guiding groove defined in a distal end of the protrusion, the guiding groove communicates with the first rotating aperture, the guiding groove is configured to guide the first shaft into the first rotating aperture.

5. The key assembly of claim 4, wherein the protrusion has two expanding portions respectively formed at two sides of the guiding groove, when the first shaft moves in the guiding groove, the expanding portions are bent away from each other to enlarge the width of the guiding groove such that the first shaft can easily enter into the first rotating aperture.

6. The key assembly of claim 2, wherein the key has a trough defined opposite to the shaft portion.

7. The key assembly of claim 1, wherein the contacting members are located on the same side of the key as the shaft portion is located.

8. The key assembly of claim 1, wherein each contacting member is substantially V-shaped, and V-shaped openings of the contacting members face each other.

9. A key assembly comprising:

a base plate, the base plate having an opening defined therein; and a key, the key received in the opening, and including two key sections connected with each other via a shaft portion, the key including two contacting portions respectively mounted on the two key sections, the shaft portion being rotatably mounted to the base plate;

wherein the contacting portions face each other and are respectively parallel to the key sections; when one of two key sections is pressed to rotate about the shaft portion, the contacting member mounted on said one of two key sections moves in a direction perpendicular to the direction that said one of two key sections is pressed, and the contacting member mounted on another one of the two key sections moves in a direction reverse to the direction that the contacting member mounted on said one of the two key sections moves.

10. The key assembly of claim 9, wherein the shaft portion has a first shaft and a second shaft respectively protruding from two opposite ends thereof, the first shaft and the second shaft are co-axial, the base plate has a first rotating aperture and a second rotating aperture opposite to and coaxial with the first rotating aperture, the first shaft is rotatably accommodated in the first rotating aperture, the second shaft is rotatably accommodated in the second rotating aperture.

11. The key assembly of claim 10, wherein the base plate has includes a peripheral wall and a bottom wall perpendicularly connected to the peripheral wall, the opening is defined in the peripheral wall, the peripheral wall has a protrusion protruding from an inner surface thereof, the first rotating aperture is defined in the protrusion facing the bottom wall, the second rotating aperture is defined in the bottom wall.

12. The key assembly of claim 11, wherein the protrusion has a surface facing the bottom wall, the first aperture defined in the surface of the protrusion, the protrusion further has a guiding groove defined in a distal end of the protrusion, the guiding groove communicates with the first rotating aperture, the guiding groove is configured to guide the first shaft into the first rotating aperture.

13. The key assembly of claim 12, wherein the protrusion has two expanding portions respectively formed at two sides of the guiding groove, when the first shaft moves in the guiding groove, the expanding portions are bent away from each other to enlarge the width of the guiding groove such that the first shaft can easily enter into the first rotating aperture.

14. A portable electronic device comprising:

a base plate, the base plate having an opening defined therein;

a circuit board, the circuit board having a first switch and a second switch located spaced from the first switch, the first switch having a first contact mounted thereon, the second switch having a second contact located opposite to the first contact; and a key assembly comprising:

a key, the key accommodated in the opening, and including a first key section, a second key section connecting with the first key section and a shaft portion protruding from the junction of the first key section and the second key section, the shaft portion being rotatably mounted to the base plate, the key further including two contacting members, one contacting member is mounted on the first key section, another contacting member is mounted on the second key section;

wherein each contacting member has a contacting portion protruding from a distal end thereof toward the other contacting member, the contacting portions respectively parallel to the first key section and the second key section; the first switch and the second switch are located between the contacting portions, when the first key section is pressed to rotate about the shaft portion, the contacting member mounted on the first key section moves in a direction perpendicular to the direction that the first key section is pressed to trigger the first contact, and the contacting member mounted on the second key section moves in a direction reverse to the direction that the contacting member mounted on the first key section moves to move away from the second contact.

15. The portable electronic device of claim 14, wherein the shaft portion has a first shaft and a second shaft respectively protruding from two opposite ends thereof, the first shaft and the second shaft are co-axial, the base plate has a first rotating aperture and a second rotating aperture opposite to and coaxial with the first rotating aperture, the first shaft is rotatably accommodated in the first rotating aperture, the second shaft is rotatably accommodated in the second rotating aperture.

16. The key assembly of claim 15, wherein the base plate has includes a peripheral wall and a bottom wall perpendicularly connected to the peripheral wall, the opening is defined in the peripheral wall, the peripheral wall has protrusion protruding from an inner surface thereof, the first rotating aperture is defined in the protrusion facing the bottom wall, the second rotating aperture is defined in the bottom wall.

17. The key assembly of claim 16, wherein the protrusion has a surface facing the bottom wall, the first aperture defined in the surface of the protrusion, the protrusion further has a guiding groove defined in a distal end of the protrusion, the guiding groove communicates with the first rotating aperture, the guiding groove is configured to guide the first shaft into the first rotating aperture.

18. The key assembly of claim 17, wherein the protrusion has two expanding portions respectively formed at the two sides of the guiding groove, when the first shaft move in the guiding groove, the expanding portions are bent away from each other to enlarge the width of the guiding groove such that the first shaft can easily enter into the first rotating aperture.

* * * * *

UNITED STATES PATENT AND TRADEMARK OFFICE

CERTIFICATE OF CORRECTION

PATENT NO. : 8,278,578 B2
APPLICATION NO. : 12/502302
DATED : October 2, 2012
INVENTOR(S) : Mu-Wen Yang et al.

It is certified that error appears in the above-identified patent and that said Letters Patent is hereby corrected as shown below:

On the title page, please insert Item (30) regarding "Foreign Application Priority Data" with the following:

-- (30) Foreign Application Priority Data

Aug. 27, 2008 (CN) .....200810304217.6 --

Signed and Sealed this
Twenty-ninth Day of October, 2013

Teresa Stanek Rea
*Deputy Director of the United States Patent and Trademark Office*